US005318149A

United States Patent [19]

Moog

[11] Patent Number: 5,318,149

[45] Date of Patent: Jun. 7, 1994

[54] APPARATUS FOR INSPECTING THE UNDERSIDE OF BRIDGES

[76] Inventor: Alfons Moog, Untersiggingen 110, 7774 Deggenhausertal 3, Fed. Rep. of Germany

[21] Appl. No.: 768,438

[22] PCT Filed: Mar. 23, 1990

[86] PCT No.: PCT/DE90/00233

§ 371 Date: Sep. 25, 1991

§ 102(e) Date: Sep. 25, 1991

[87] PCT Pub. No.: WO90/11407

PCT Pub. Date: Oct. 4, 1990

[30] Foreign Application Priority Data

Mar. 25, 1989 [DE] Fed. Rep. of Germany ... 8903771[U]

[51] Int. Cl.[5] ..... E04G 3/00

[52] U.S. Cl. ..... 182/63; 182/2; 182/62.5

[58] Field of Search ..... 182/63, 113, 223, 62.5, 182/64, 65, 68, 2, 140, 150, 142; 14/69.5, 71.1

[56] References Cited

U.S. PATENT DOCUMENTS

| | | | |
|---|---|---|---|
| 2,669,490 | 2/1954 | Kaufman | 182/63 |
| 3,608,669 | 9/1971 | Lindsay, Jr. | 182/63 X |
| 3,927,732 | 12/1975 | Ooka et al. | 182/63 X |
| 4,074,790 | 2/1978 | Colbachini et al. | 182/63 |
| 4,154,318 | 5/1979 | Mallcone | 182/62.5 X |
| 4,449,611 | 5/1984 | Frey-Wigger | 182/63 |
| 4,556,124 | 12/1985 | Lotto | 182/63 |
| 4,633,975 | 1/1987 | Connor et al. | 182/63 |
| 4,696,371 | 9/1987 | Moog | 182/63 |
| 4,893,696 | 1/1990 | Moog . | |

FOREIGN PATENT DOCUMENTS

| | | | |
|---|---|---|---|
| 0156304 | 10/1985 | European Pat. Off. . | |
| 3305384 | 3/1984 | Fed. Rep. of Germany . | |
| 3723925 | 2/1989 | Fed. Rep. of Germany . | |
| 3824921 | 1/1990 | Fed. Rep. of Germany | 182/63 |

OTHER PUBLICATIONS

Barin, S.Rl. "Automatic Bridge Control", undated, pp. 1–9.

*Primary Examiner*—Karen J. Chotkowski

*Attorney, Agent, or Firm*—Spencer, Frank & Schneider

[57] ABSTRACT

There is described an apparatus for inspecting the underside of bridges, with an undercarriage (1), an intermediate carrier (11) attached to this, a guide member (9) mounted on the intermediate carrier rotatably about a horizontal axis of rotation (12), and a lifting tower (4) received by the guide member, movable perpendicularly relative to its axis of rotation and having four corner spars. The guide member (9) has a flat shape and is in sliding engagement only with the two corner spars adjacent to it, these two corner spars being designed with a higher load-bearing capacity than the other two. The intermediate carrier (11) is preferably mounted on the undercarriage (1) by means of a lever parallelogram pivotable about vertical axes and consisting of at least two levers (13( 14) (FIG. 6).

12 Claims, 6 Drawing Sheets

APPARATUS FOR INSPECTING THE UNDERSIDE OF BRIDGES

BACKGROUND OF THE INVENTION

The invention relates to an apparatus for inspecting the underside of bridges, with an undercarriage, an intermediate carrier attached to the undercarriage, a guide member mounted on the intermediate carrier rotatably about a horizontal axis of rotation, a lifting tower received by the guide member, movable perpendicularly relative to its axis of rotation and having four corner spars, a lifting-tower bottom part mounted on the lifting tower rotatably about its longitudinal mid-axis, and a work platform attached to the lifting-tower bottom part.

In known apparatuses of this type for inspecting the underside of bridges, the lifting tower has a symmetrical, especially square cross-section, and the guide member encloses it all round. Such a guide member of hollow cross-section which receives the tower cross-section, is also designated as a guide box. Disadvantages are the large amount of space required, which makes it difficult to fold the apparatus together compactly for transport, and the unfavorable weight distribution as a result of the symmetrical cross-section of the lifting tower.

SUMMARY OF THE INVENTION

The object on which the invention is based is to provide a compact apparatus of increased stability for inspecting the underside of bridges which is versatile to use and which can be erected automatically.

Starting from an apparatus of the type designated in the introduction, this object is achieved according to the invention in that the guide member has a flat shape and is in sliding engagement only with the two corner spars of the lifting tower adjacent to it, and in that these corner spars are designed with a higher loadbearing capacity than the other two corner spars. Racks can also be attached to the load-bearing corner spars and interact with a rack mechanism on the guide member for driving the lifting tower. As a result of this provision, the weights of the lifting tower and of the guide member are concentrated on the bridge side to a substantially higher degree, above all when the corner spars remote from the bridge and the struts consist of light metal.

Preferably, the guide member is mounted by means of a live ring on the intermediate carrier which is preferably likewise flat and plate-shaped. In order to extend the lifting tower almost up to its free end, the guide member has in relation to its axis of rotation preferably a shorter portion pointing to the free end of the lifting tower and a longer portion pointing to the work platform.

To avoid endangering the traffic when the apparatus is erected on a road bridge, it is proposed that the intermediate carrier be mounted on the undercarriage by means of a lever parallelogram pivotable about vertical axes and consisting of at least two levers. The unit composed of the lifting tower and work platform and folded together for transport can thereby be lifted parallel to itself above and beyond the bridge edge and then set up by pivoting about the horizontal axis of rotation. The parallel levers are preferably telescopic. A third parallel lever, preferably arranged at somewhat greater height, can also be provided. If these three parallel levers are individually telescopic and releasable from the intermediate carrier, the erected be available for traffic over their entire width, it is proposed that the intermediate carrier be attachable to the narrow side of a movable gantry structure. It can be the same intermediate carrier articulated otherwise on the parallel levers of the undercarriage. Instead, it is connected to jibs of variable length of the gantry structure which are appropriately attached to a slide movable vertically on the gantry structure. To move round lampposts or the like, here too three jibs arranged at horizontal spacings, of individually variable length and releasable from the intermediate carrier can be provided.

A further proposal is also to carry the supporting gantry on the same road-transport vehicle as the remaining apparatus. Preferably, the gantry structure is telescopic horizontally and transversely relative to the direction of travel and is equipped with guide rollers. It has on one narrow side an aperture for a road vehicle, on which is loaded a constructional unit consisting of the intermediate carrier, guide member, lifting tower and work platform. For additionally receiving the gantry structure on this road vehicle, connecting elements suitable for this are provided. The receiving devices for the intermediate carrier and the remaining components of the apparatus are attached to the other narrow side of the gantry structure which, in the loaded position, is on the rear side of the vehicle.

Finally, it is proposed that the range of rotary angle of the rotary drive of the guide member should amount to at least 270°, thereby making it possible, on apparatuses for inspecting the underside of bridges with a work platform which can be tilted up against the lifting tower, to do without any driving device for this tilting movement. Conventionally, hydraulic cylinders or rope winches are installed for this purpose. With the direction of rotation selected correctly, the tilting open and tilting in take place in accordance with the rotational movement, with the work platform swinging freely until the angle stop is reached.

BRIEF DESCRIPTION OF THE DRAWINGS

Exemplary embodiments of the invention are described in more detail below with reference to the drawing.

DESCRIPTION OF THE PREFERRED EMBODIMENTS

Figure 1:
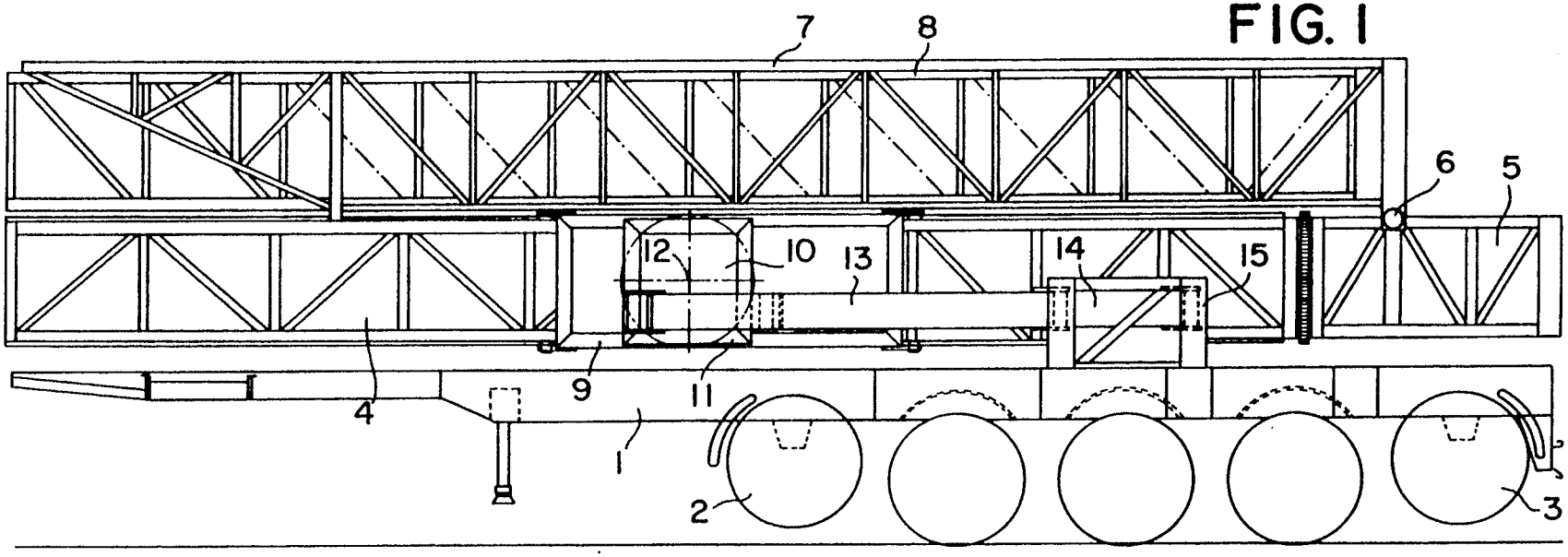
FIG. 1 shows the side view of an apparatus for inspecting the underside of bridges which is loaded on its undercarriage for road transport.
Figure 2:
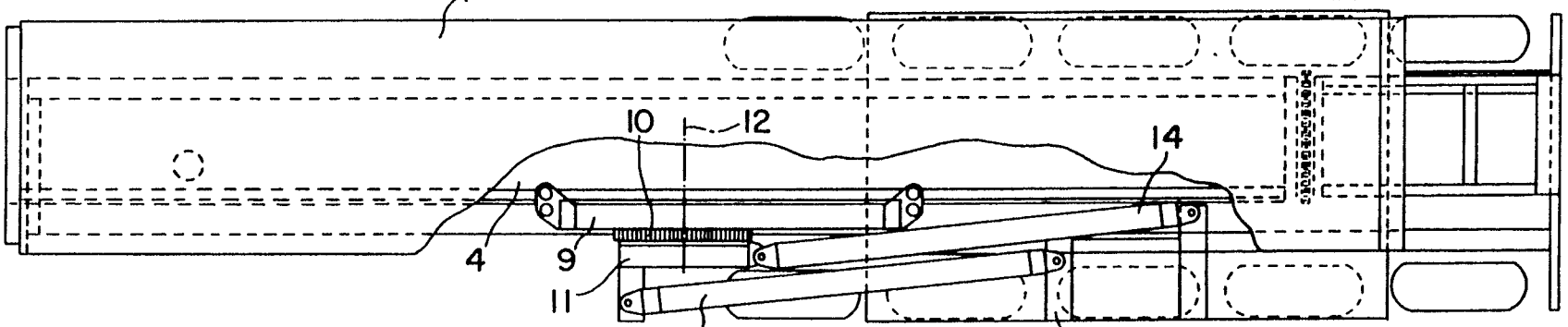
FIG. 2 shows the top view of the apparatus according to FIG. 1.
Figures 3, 6:
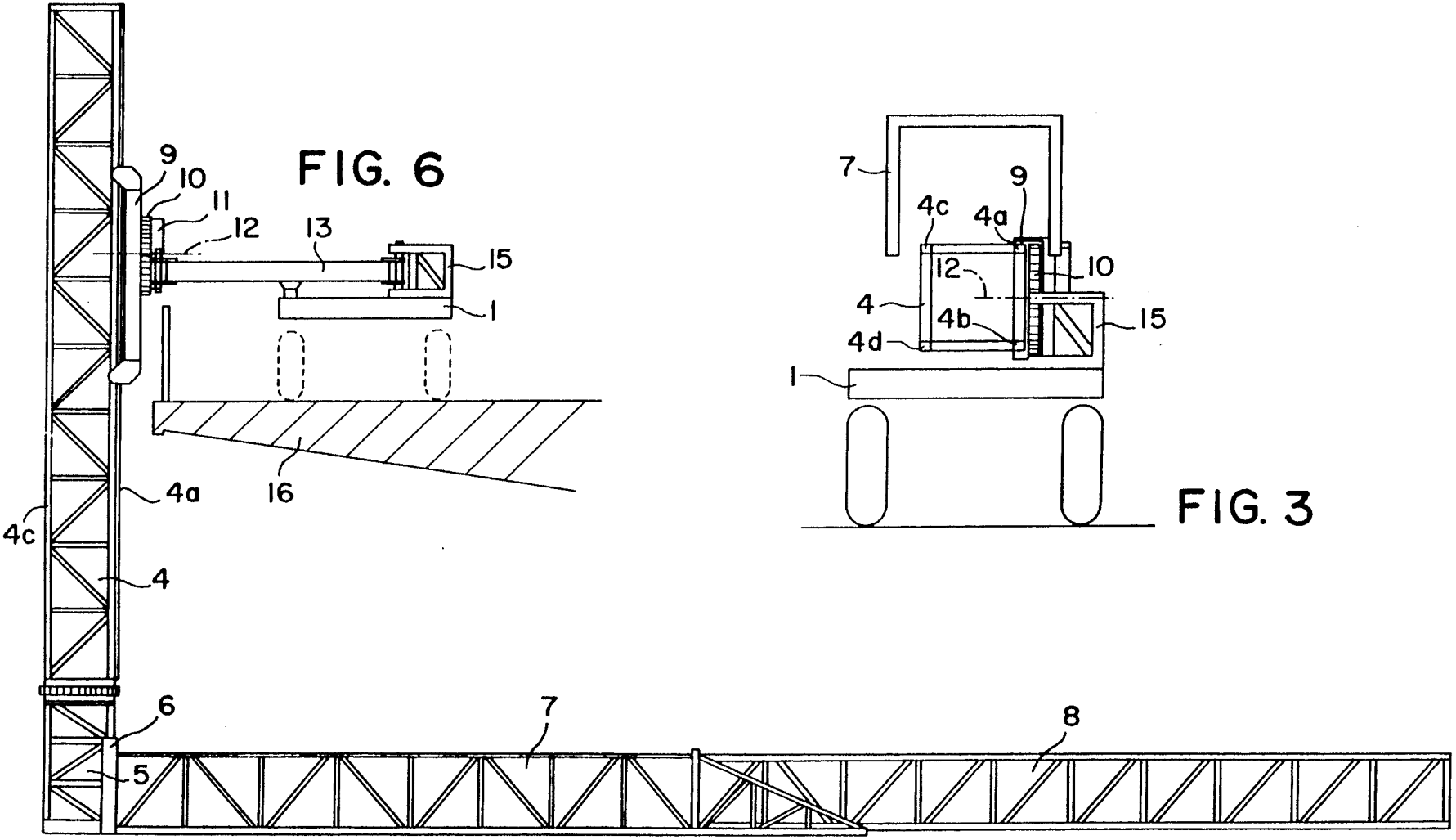
FIG. 3 shows the view of the apparatus according to FIG. 1 in the direction of travel.
FIG. 6 shows a view of the apparatus according to FIG. 1 in the longitudinal direction of the bridge and in the operating state.

The apparatus according to FIGS. 1 to 6 is built on a five-axle semitrailer which serves at the same time as a transport and operating undercarriage. By means of the air-suspension arrangement of the three middle axles, the chassis 1 is raised for road transport so far that the wheels 2 and 3 of the non-sprung outer axles lift off from the road. The lifting tower 4 has a rotatable lifting-tower bottom part 5. Articulated on this about a tilting axis 6 is the work platform 7 which has a telescopic additional platform 8. With particular reference to FIGS. 3 and 6, the lifting tower 4 is an elongated, rectangular, column-like frame structure having four longitudinally extending corner spars 4*a*, 4*b*, 4*c* and 4*d*. The lifting tower 4 is guided longitudinally movably on an elongate flat guide member 9 by means of its two corner spars 4*a* and 4*b* facing this guide member. For this, the reinforced spars have a corresponding cross-sectional profile and, if there is a rack mechanism, a rack. The corner spars 4*a* and 4*b* have a greater load-bearing capacity than the corner spars 4*c* and 4*d*. The guide member 9 is mounted by means of a live ring 10 on a flat intermediate carrier 11 so as to be rotatable about a horizontal axis of rotation 12. Care is taken to ensure that a rotational movement over at least 270° in both directions is possible. The intermediate carrier 11 is mounted on the chassis 1 by means of two parallel levers 13 and 14. The joints located on the undercarriage are arranged on a bearing block 15. The joint axes extend vertically, so that the intermediate carrier 11 and with it all the further parts can be lifted off laterally from the chassis parallel to themselves in their transport position.

Figure 4:
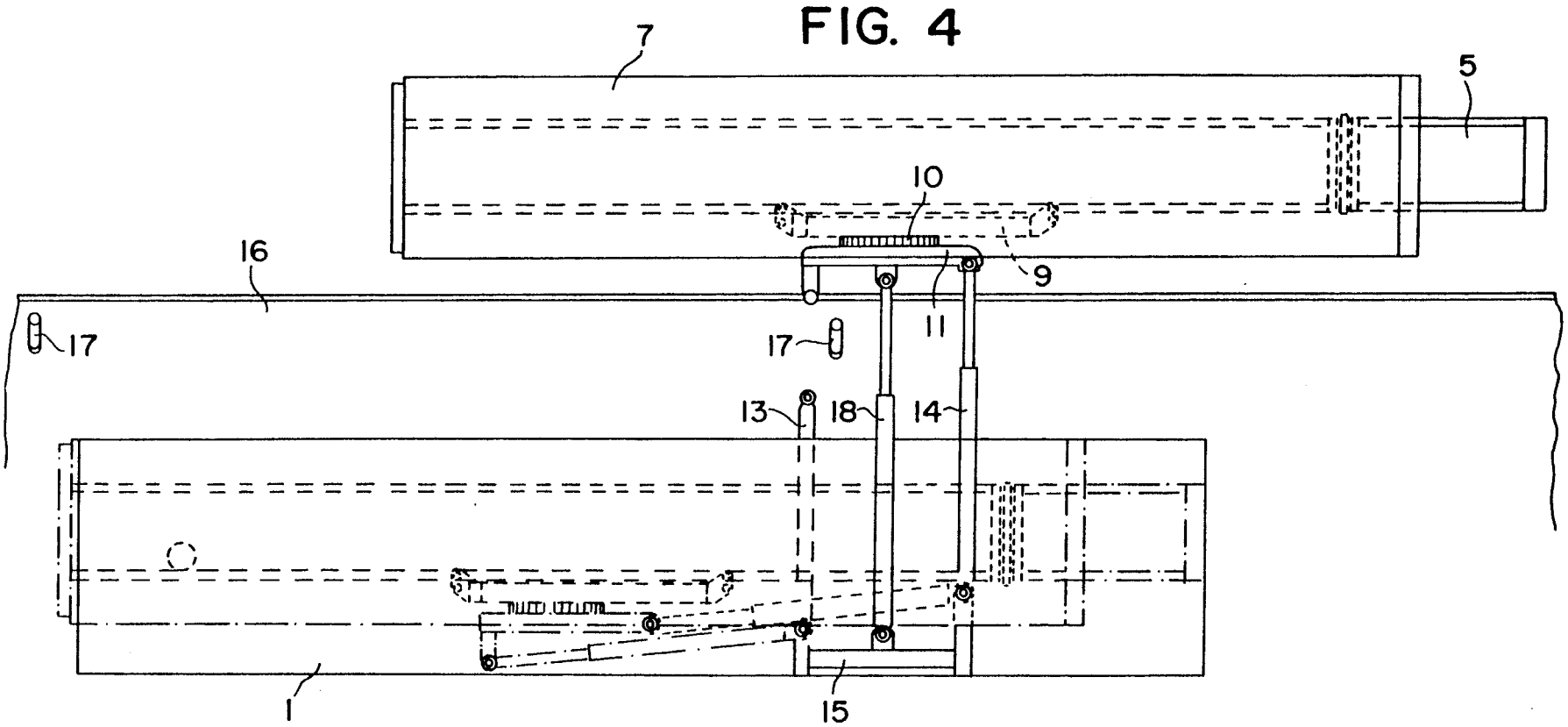
FIG. 4 shows the top view of the apparatus according to FIG. 1 after the parallel arms have been swung out.

The completed extension movement at the edge of a bridge 16 is shown in FIG. 4. Here, in contrast to the preceding figures, to demonstrate how the apparatus goes round lamp posts 17 or the like at the edge of the bridge a third parallel lever 18 is shown which is arranged in the middle between the other two and at somewhat greater height. By pivoting the parallel levers through somewhat more than 90°, the apparatus parts still folded together have been lifted above and beyond the edge of the bridge, where they are initially still in a horizontal position. The work platform 7 is at the top and, as also shown in FIG. 3, points with its bottom upwards.

Figure 5:
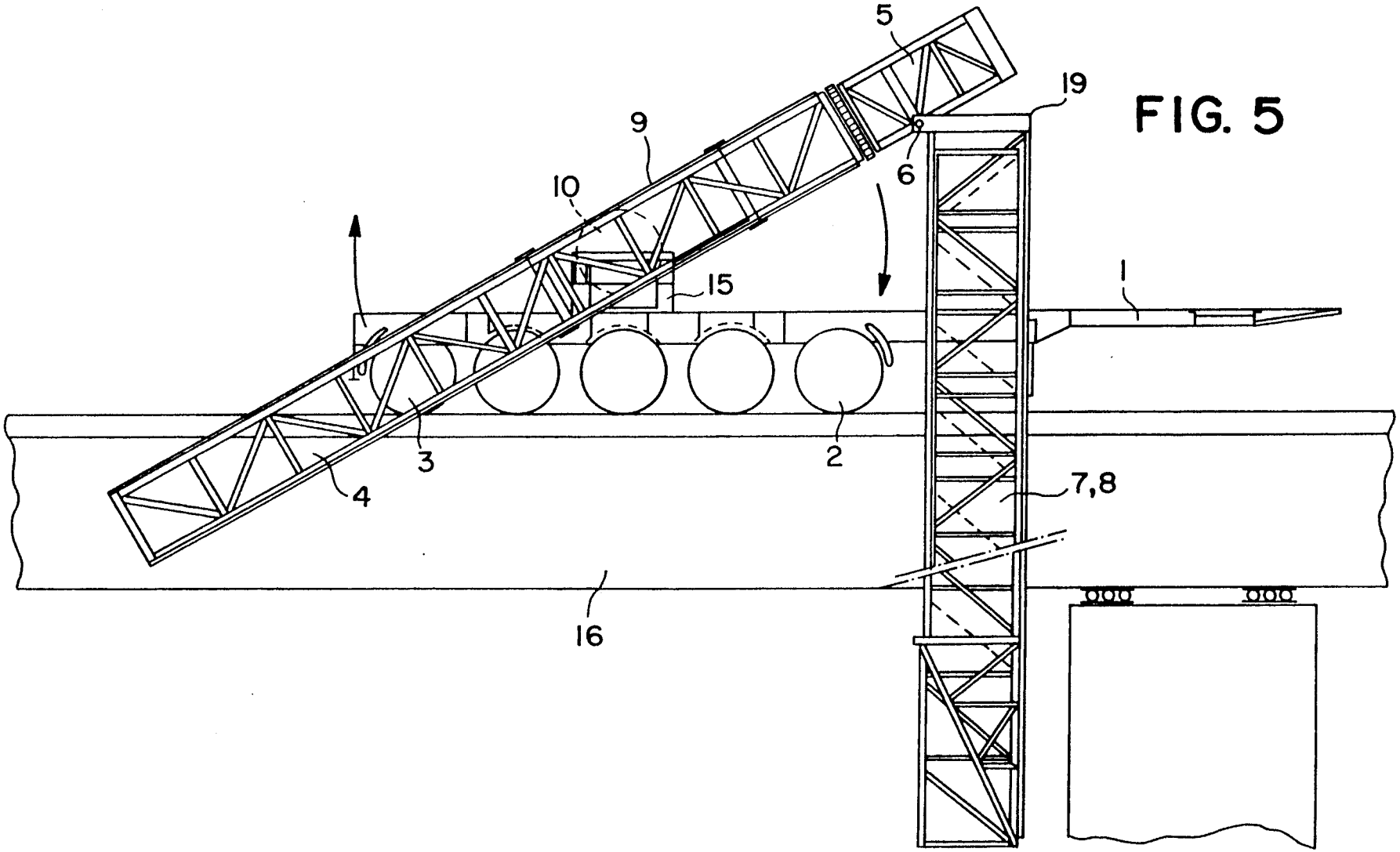
FIG. 5 shows a side view of the apparatus according to FIG. 1 on the bridge during the erection operation.
Figure 7:
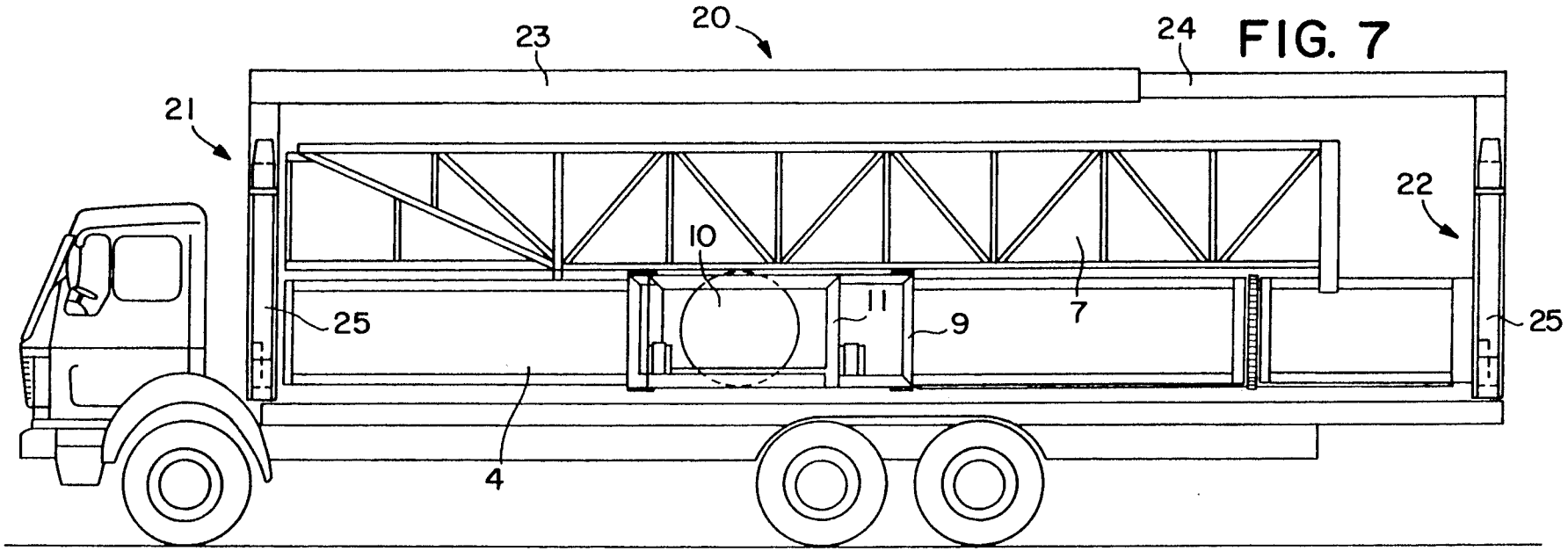
FIG. 7 shows the side view of another apparatus for inspecting the underside of bridges, in the loading position on a road-transport vehicle.
Figure 8:
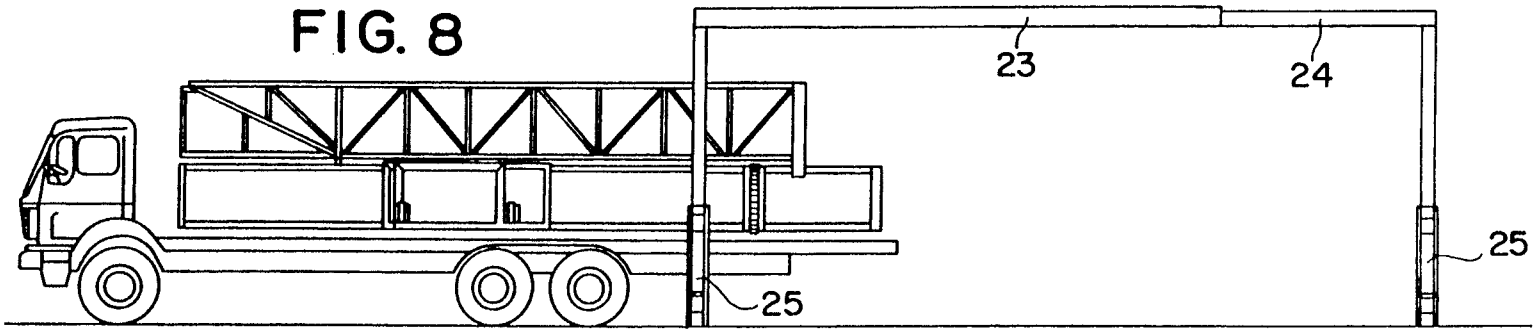
FIG. 8 shows the same apparatus as in FIG. 7 on a smaller scale at the start of the erection operation.

If the arrangement is now viewed according to FIG. 5 from the outside of the bridge, the lifting-tower bottom part 5 first points to the left. The lifting tower is now rotated to the right (arrow in FIG. 5). As soon as it is vertical, the work platform 7 hangs freely downwards and during the further rotational movement comes loose from the tower According to FIG. 5, the tower has already covered an angle of 150°. As soon as a further 30° are covered, the edge, designated by 19, of the work platform comes to bear on the lifting-tower bottom part 5. During the further 90° the work platform no longer moves in relation to the tower. It finally stands horizontally and, after a corresponding lowering of the lifting tower 4, can be pivoted under the bridge. In conclusion, the additional platform 8 is also extended. This working position is shown in FIG. 6, as seen from the pier of the bridge. The dismounting of the apparatus takes place in reverse order and in the opposite direction of rotation in relation to the axis of rotation 12.

In so far as the third parallel lever 18 is present according to FIG. 4, it is possible to go round the lamp-posts when the apparatus is in the erected state. For this, it is further necessary that, as likewise shown in FIG. 4, all three parallel levers be telescopic and releasable from the intermediate carrier 11. The arrangement is such that two parallel levers alone can carry the apparatus for inspecting the underside of bridges. The figure shows how the parallel lever 13 is released from the intermediate carrier and retracted as long as the undercarriage moves to the left until the lamp post 17 is located between the parallel levers 13 and 18. In this position, the parallel lever 13 is coupled again and the parallel lever 18 retracted, and so on and so forth.

Figure 10:
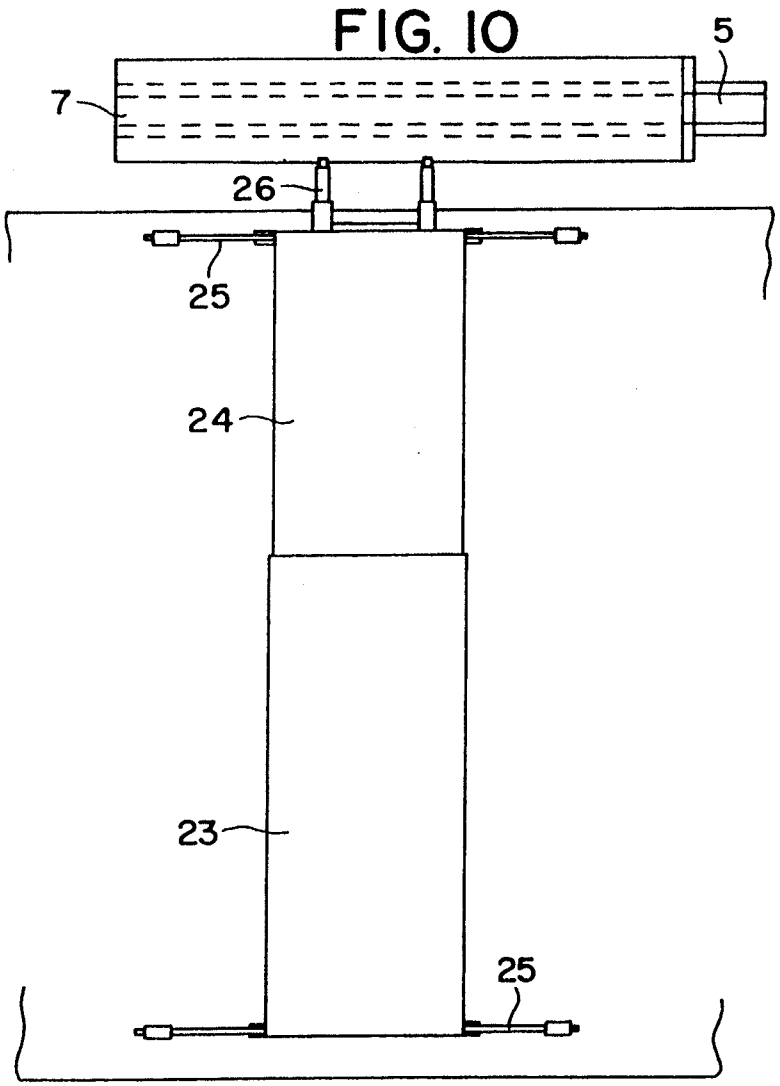
FIG. 10 shows a top view as in FIG. 9 with a further intermediate position during the erection of the apparatus according to FIG. 7.
Figure 9:
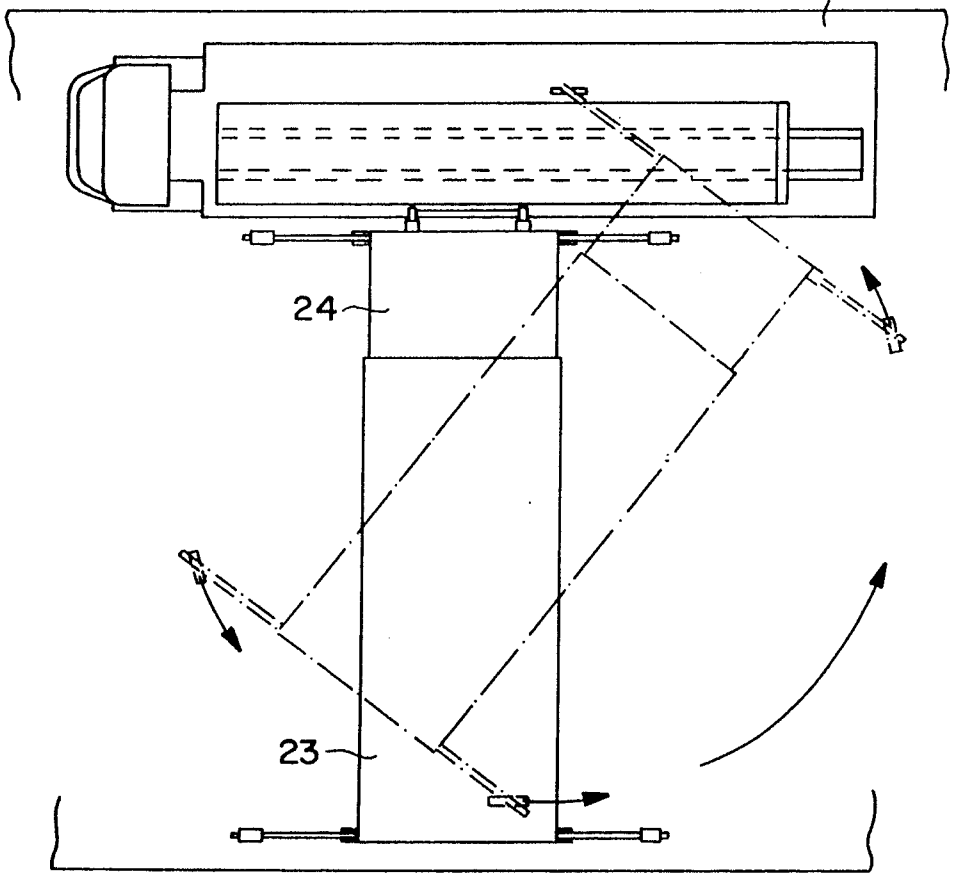
FIG. 9 shows a top view on the same scale as FIG. 8 with two further intermediate positions during the erection.

The apparatus illustrated in FIGS. 7 to 10 works with a gantry structure movable on guide rollers and consisting of a horizontal upper part 20 and two side parts 21 and 22. The upper part has two portions 23 and 24 which can be telescoped one in the other and each of which is connected firmly to a side part. These portions can consist of telescopic tubes, lattice poles, a lattice work or the like. A three-axle motor truck serves as a pure transport vehicle. It carries, on the one hand, a constructional unit composed of an intermediate carrier 11, live ring 10, guide member 9, lifting tower 4 and work platform 7, as in the first example and as described in FIG. 1, and, on the other hand, the gantry structure retracted to its shortest position. At the four corners, legs 25 equipped with guide rollers are folded up. The constructional unit is lower than the gantry structure, with legs folded up. The two side parts of the gantry structure are of different design. The side part 21 forms a large aperture, so that, according to FIG. 8, after the legs 25 have been folded out the gantry structure stands on the road, especially of a bridge, and the motor truck can move out through the aperture of the side part 21. The further erection operation is shown in FIGS. 9 and 10. The gantry structure is first unloaded in the direction of travel, that is to say in the longitudinal direction of the bridge, and is subsequently rotated by means of its guide rollers (as represented by dot-and-dash lines in FIG. 9), until it assumes a position transverse relative to the bridge. The motor truck now likewise moves in the longitudinal direction of the bridge and therefore parallel up against the side wall 22 of the gantry structure. Attached to this side part is a slide which is movable up and down and which has horizontal telescopically extendable arms 26. These are connected to the joint lugs of the intermediate carrier 11. By moving said slide upwards on the side part 22, the constructional unit is lifted off from the motor truck and the latter can move away. The portions 23 and 24 of the upper part of the gantry structure are now moved apart from one another, until the side part 22 comes to rest on the bridge edge and the gantry structure consequently spans the entire road. If necessary, the arms 26 can be extended even further, so that the constructional unit is raised above and beyond the bridge and is initially still held horizontally on the gantry structure. This is shown in FIG. 10. The further erection of the apparatus takes place as described in the first example.

It will be understood that the above description of the present invention is susceptible to various modifications, changes and adaptations, and the same are intended to be comprehended within the meaning and range of equivalents of the appended claims.

I claim:

1. An apparatus for inspecting an underside of a bridge, comprising (a) an undercarriage having a length dimension;

(b) means for providing for travel of said undercarriage in a direction parallel to said length dimension;

(c) an intermediate carrier;

(d) first coupling means for connecting said intermediate carrier to said undercarriage for displacement of said intermediate carrier relative to said undercarriage;

(e) a lifting tower generally shaped as a rectangular column and having a length dimension; said lifting tower having four corner spars extending parallel to the length dimension of said lifting tower and defining four sides thereof; a first and a second of said four corner spars defining a first of said four sides; said first and second corner spars having a load-bearing capacity greater than a load-bearing capacity of a third and fourth of said four corner spars;

(f) a guide member having a generally flat configuration, disposed adjacent said lifting tower solely along said first side thereof; said guide member having means for slidably engaging solely said first and second corner spars for providing a gliding displaceability of said lifting tower relative to said guide member in a direction parallel to said length dimension of said lifting tower;

(g) second coupling means for connecting said guide member to said intermediate carrier for rotary displacement of said guide member relative to said intermediate member about a horizontal axis of rotation oriented perpendicularly to said length dimension of said undercarriage;

(h) a work platform; and (i) third coupling means for connecting said work platform to said lifting tower for displacement of said work platform relative to said lifting tower.

2. The apparatus as defined in claim 1, wherein said second coupling means comprises a live gear mounted on said intermediate carrier.

3. The apparatus as defined in claim 1, wherein said lifting tower has opposite first and second ends; said work platform being coupled to said lifting tower at said first end; said guide member having a first length dimension measured from said axis of rotation parallel to the length dimension of said lifting tower toward said first end; said guide member having a second length dimension measured from said axis of rotation parallel to the length dimension of said lifting tower toward said second end; said first length dimension of said guide member being longer than said second length dimension thereof.

4. The apparatus as defined in claim 1, wherein said first coupling means comprises a lever parallelogram having at least two levers each joined to said intermediate carrier and said undercarriage for pivotal motion about vertical axes.

5. The apparatus as defined in claim 4, wherein each lever includes two telescoping lever portions.

6. The apparatus as defined in claim 5, wherein the number of said levers is three and further wherein each said lever is releasable from said intermediate carrier.

7. The apparatus as defined in claim 1, wherein said work platform has a length dimension and further wherein said third coupling means comprises means for providing for a tilting motion of said platform to assume a working position in which said length dimension of said work platform is at an angle other than zero to the length dimension of said lifting tower and to assume a transporting position in which said length dimension of said work platform is parallel to said length dimension of said lifting tower and said work platform and said lifting tower are in a superposed relationship.

8. The apparatus as defined in claim 1, wherein said undercarriage comprises a travelling gantry structure having a relatively wide side and a relatively narrow side and further having a straight travelling direction; said first coupling means connecting said intermediate carrier to said relatively narrow side of said travelling gantry structure.

9. The apparatus as defined in claim 8, wherein said first coupling means comprises a plurality of length-variable jibs.

10. The apparatus as defined in claim 9, wherein said jibs are horizontally spaced from one another and are releasable from said intermediate carrier.

11. The apparatus as defined in claim 8 in combination with a road vehicle; said gantry structure having interengaging frame members telescoping in a horizontal direction perpendicularly to said straight travelling direction; said gantry structure having bottom rollers for travel; said relatively narrow side of said gantry structure having an opening sufficiently large to allow passage of said road vehicle through said gantry structure; said road vehicle including means for supporting thereon an assembly formed of said intermediate carrier, said guide member, said lifting tower and said work platform; further comprising connecting elements receiving said gantry structure on said road vehicle.

12. The apparatus as defined in claim 1, wherein said guide member is rotatable relative to said intermediate member through an angle up to at least 270 degrees.

* * * * *